United States Patent [19]

Kuttenbaum et al.

[11] 4,331,436

[45] May 25, 1982

[54] MACHINE FOR ERECTING AND COUNTERFOLDING COLLAPSED BOXES

[75] Inventors: Valentin Kuttenbaum, Laupheim; Ernst Henle, Schwendi-Weihungszell, both of Fed. Rep. of Germany

[73] Assignee: Josef Uhlmann Maschinenfabrik GmbH & Co. KG, Laupheim, Fed. Rep. of Germany

[21] Appl. No.: 134,987

[22] Filed: Mar. 28, 1980

[30] Foreign Application Priority Data

Apr. 3, 1979 [DE] Fed. Rep. of Germany ..... 2913325

[51] Int. Cl.[3] ..... B31B 1/78

[52] U.S. Cl. ..... 493/310; 493/319

[58] Field of Search ..... 493/310, 311, 318, 319, 493/408–409, 315, 309, 177, 180–182

[56] References Cited

U.S. PATENT DOCUMENTS

| | | | |
|---|---|---|---|
| 2,601,481 | 6/1952 | Williams | 493/319 X |
| 3,122,071 | 2/1964 | Vogel | 493/310 |
| 4,011,799 | 3/1977 | Chidsey | 493/314 |

FOREIGN PATENT DOCUMENTS

| | | | |
|---|---|---|---|
| 650904 | 3/1951 | United Kingdom | 493/310 |
| 832346 | 4/1960 | United Kingdom | 493/310 |

*Primary Examiner*—James F. Coan

*Attorney, Agent, or Firm*—Karl F. Ross

[57] ABSTRACT

A device for erecting and countercollapsing boxes from preformed blanks comprises a carrier arm pivotally attached to a chain drive and guided by a generally oval track to engage at a feed station the back edge of a blank for pushing the same through a pair of parallel guide slots along a path to an erecting station defined by rotary carrier synchronized with the chain drive for revolving a stopper to have, upon the emergence of the blank from the guide slots, a distance from the slots' exit substantially equal to the width of the blank and an orientation parallel to front and back edges of the blank. The stopper catches at the slots' exit the front blank edge and continues to revolve with tangential speed less than the speed of the arm, whereby relative motion of the stopper and the arm gives rise to a compressive force which opens and countercollapses a box from the blank. A convex arresting surface on the rotary carrier engages a side of the box only upon the determination of a collapsing phase to limit lateral motion of the box during a pushing thereof by the arm into removal slots. The stopper includes a radial surface inclinable toward the exit of the feed slots for facilitating a catching of the front blank edge and toward the removal slots, upon further rotation of the rotary carrier, for facilitating the sliding of the countercollapsed box from the erecting station.

12 Claims, 8 Drawing Figures

MACHINE FOR ERECTING AND COUNTERFOLDING COLLAPSED BOXES

FIELD OF THE INVENTION

Our present invention relates to a device for erecting and counterfolding boxes from blanks.

BACKGROUND OF THE INVENTION

In the process of packaging goods in boxes made of cardboard, plastic foil, etc., the boxes are initially in the form of blanks stackable for convenient transport. The blanks must be broken open and erected prior to filling with consumer material. Because such boxes have a tendency to close again due to internal stresses, it is frequently necessary to fold or bend the boxes into a more or less flattened form along a diagonal plane different than the one along which the blanks were formed. Such counterfolding serves to relieve a box of stresses engendered during production and transport.

OBJECTS OF THE INVENTION

An object of our present invention is to provide a simple device for erecting and counterfolding boxes from blanks.

Another object of our present invention is to provide such a device which is capable of handling boxes of different dimensions.

A more particular object of our present invention is to provide such a device which is readily adaptable for combination with machines for filling the erected boxes and for tucking in the end flaps thereof.

SUMMARY OF THE INVENTION

A box utilized in packaging manufactured or processed goods generally comprises four rectangular sides joined together at four parallel edges, the sides having widths measured perpendicularly with respect to the edges; the box has at least two end flaps joined to the sides at opposite ends of the box for closing the same upon the filling thereof. A blank from which the box is formed has a front edge and a back edge parallel thereto, these edges corresponding to two of the box edges and being spaced by a separation equal to the sum of the widths of two adjoining sides.

A device for automatically erecting and counterfolding a box from its blank form at least temporarily into a prismatic form comprises, according to our present invention, a first guide on a frame for directing the blank along a path extending from a feed or input station to an erecting station at an output of the guide. A carrier is movably mounted on the frame for engaging the back edge of the blank to push the same along the input path, while a stopper is attached to the frame at the erecting station for engaging the front edge of the blank to arrest the same upon an emergence of the front edge from the guide outlet and for coacting with the carrier during a spreading phase to exert on the box a compressive force oriented along a box diagonal extending through the front and back blank edges to the stopper. The stopper is shiftably mounted on the frame for revolving about an axis substantially parallel to the edges of the blank to be disposed, upon the emergence of the blank from the first guide, substantially transversely to the guide path and parallel to the blank edges and at a distance from the guide outlet at least equal to the width of the blank.

A second guide on the frame extends from the erecting station for receiving a box upon the termination of the collapsing phase, a feeder being provided for delivering a blank to the feed station and a conveyor being provided for removing a box from the device. A drive on the frame is operatively connected to the carrier arm for driving the same along the guide path, past the erecting station and along the second guide, whereby a blank is pushed through the first guide, the arm is shifted relatively toward the stopper for creating the compressive force and the box is pushed from the erecting station through the second guide to the conveyor. The drive is operatively connected to the stopper for revolving the same about said axis in synchronism with the motion of the carrier arm. An arrest on the frame limits the lateral motion of the box during the pushing thereof by the arm from the erecting station to the second guide.

According to another feature of our present invention, the stopper is mounted on a rotary carrier rotatable by the drive about the aforementioned axis. The arrest includes a curved surface contiguous on the rotary carrier with the stopper, which is provided with a catch surface projecting substantially perpendicularly with respect to this curved surface and oriented toward the guide outlet upon an issuing of the front edge therefrom. The rotary carrier is advantageously in the shape of a wheel, the curved surface forming a periphery of the wheel, and is adjustably mounted on the frame for selectively varying the distance of the rotation axis from the outlet, whereby the handling of differently dimensioned boxes by the device is facilitated.

According to another feature of our present invention, a guide surface extends on the frame between the outlet and the second guide for engaging the back box edge and thereby cooperating with the carrier arm and the stopper in creating the compressive force to shorten the diagonal during the spreading phase and during a collapsing phase terminating in the engagement of the carrier arm and a side of the box contiguous with the back box edge. The guide surface is disposed in a plane located a distance from the curved surface on the stopper carrier at least equal to a small width dimension of the box. The drive includes pivoting means operatively connected to the arm for controlling an angle between the carrier arm and the box diagonal to be less than 90° during the spreading and the collapsing phase, whereby the back box edge is forced against the guide surface to slide therealong. In this case, the guide surface is advantageously integral with the first guide at the outlet thereof.

Alternatively, i.e. rather than pinning the back box edge between the carrier arm and the guide surface, the pivoting means can control the inclination of the arm so that the angle between the same and the box diagonal is substantially equal to 90°, whereby any force component exerted by the arm parallel to a pushing surface thereof is eliminated and the friction force is maximized for preventing motion of the back box edge relative to the arm. The arm may be further provided with a gripper, e.g. a shoulder, for forming a locked engagement with the back box edge during the spreading phase, whereby motion of this edge relative to the arm is inhibited still further.

According to a more particular feature of our present invention, the stopper wheel has a plurality of stoppers in the form of peripheral teeth having respective radially extending surfaces each connected at an inner side to an outer side of an adjacent tooth via a curved surface and at an outer side to an inner side of another tooth via another curved surface, these curved surfaces being spiral in longitudinal cross section.

Pursuant to another feature of our present invention, force-producing means in the form of pressurized-air nozzles are disposed on the frame on opposite sides of the guide outlet at the erection station for ejecting respective air streams in opposite directions against the end flaps of the blank for exerting thereon a breaking-open force prior to the engagement of the blank front edge and the stopper, thereby ensuring proper spreading of the box upon application of the compressive force via the coaction of the carrier and the stopper.

Pursuant to still further features of our present invention, the second guide slot has a width inversely proportional to the distance from the erecting station, whereby the box is further counterbent upon a pushing thereof through the second guide by the carrier.

An advantage of a box erector according to our present invention is adaptability to box-filling machines due to the ease of changing the length and the direction of the second guide slot. In addition, such an erector may include a stack at the feed station for storing a multiplicity of blanks for successive spreading and collapsing, such an automatic feed contributing to the high capacity of the erector by enabling continuous operation.

A method for operating a box-erecting machine according to our present invention presents the advantage of ensuring the catching of a blank upon the emergence of the same from the guide outlet. To this end the stopper's catch surface is inclined toward the guide outlet upon blank emergence. Later, however, owing to the revolution of the stopper about the rotation axis, the catch surface is tilted away from the guide outlet and toward the entrance opening of the second guide, thereby facilitating removal of the countercollapsed box from the erecting station; prior to the complete removal of the box, further rotary carrier motion resolves the stopper entirely away from the erecting station.

A method for erecting and countercollapsing a box from a preformed blank with a front edge and a back edge having a separation equal to the sum of the widths of two adjacent sides of the box comprises, according to our present invention, the steps of pushing the blank at the back edge thereof along a guide extending to an outlet juxtaposed to an erecting station and revolving a stopper about an axis substantially parallel to the edges of the blank. The revolution of the stopper is coordinated with the motion of the blank to position the stopper, upon an exiting of the blank from the guide, at a distance from the outlet substantially equal to the front-back edge separation of the blank, whereby the same is caught by the stopper. Upon arresting of the blank by the resolving stopper, the back edge of the blank is pushed toward the stopper to open and counterfold the box.

BRIEF DESCRIPTION OF THE DRAWING

These and other features of our present invention will now be described in detail, reference being made to the accompanying drawing in which.

SPECIFIC DESCRIPTION

Figure 1A:
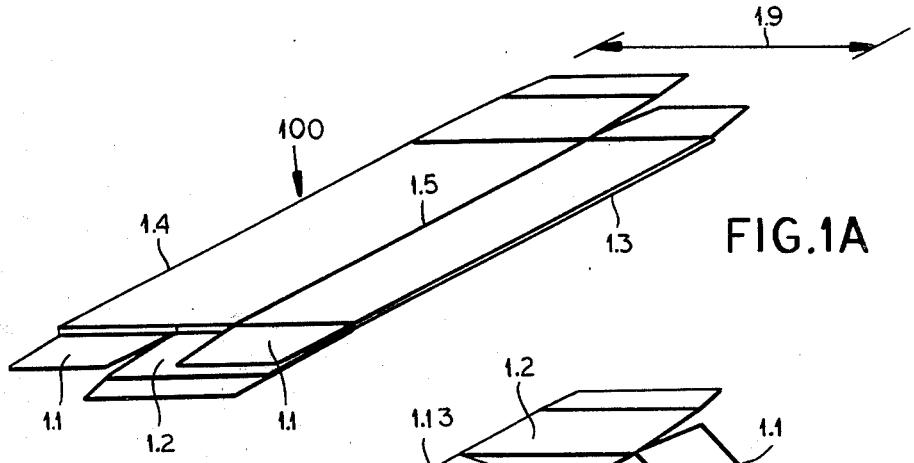
FIGS. 1A–1D are perspective views showing successive forms of a box during an erecting and counterbending process.
Figure 1B:
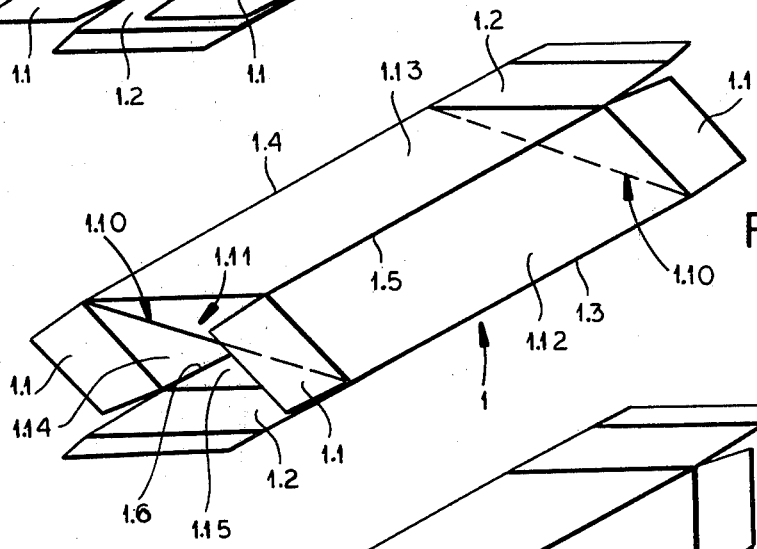
Figure 1C:
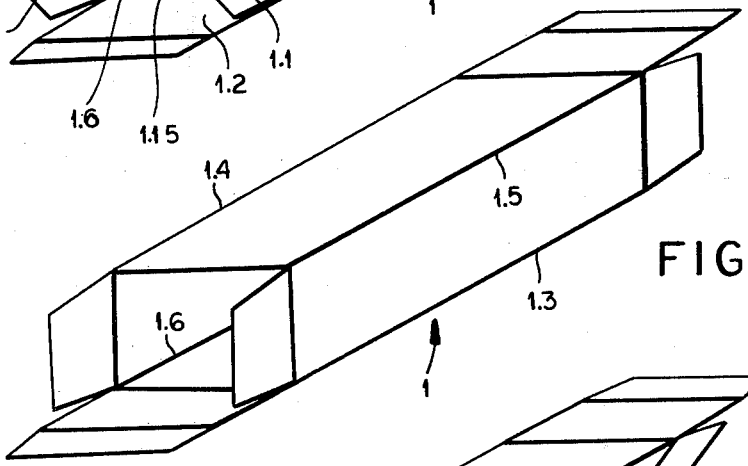

As shown in FIG. 1C, a box 1 utilizable in the packaging of a wide range of materials and products has four parallel edges 1.3–1.6 joined by rectangular box sides 1.12–1.15 (see FIG. 1B) whose widths are measured perpendicularly to the edges 1.3–1.6. At the ends of box 1 are a pair of main flaps 1.2 joined to opposite sides 1.13 and 1.15 and two pairs of auxiliary flaps 1.1 attached to sides or faces 1.12 and 1.14. Generally, empty boxes 1 are shipped as blanks 100 such as that illustrated in FIG. 1A. Each blank has two longitudinally extending outer edges 1.3 and 1.4, hereinafter called a front edge and a back edge, respectively, which correspond to the similarly designated opposing or nonadjacent edges of the opened box 1 (FIGS. 1B–1D) and which are spaced by a separation 1.9 equal to the sum of the widths of two adjacent sides 1.12, 1.13 or 1.14, 1.15.

Figure 1D:
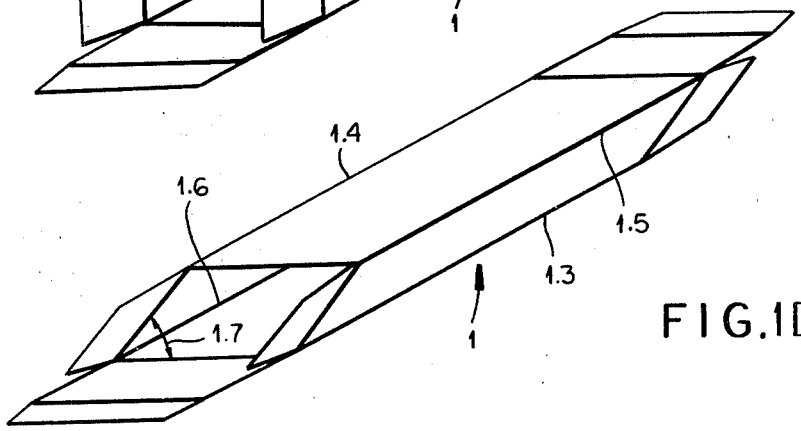

The preparation of box 1 for filling generally includes a spreading-open phase indicated in FIG. 1B and a collapsing or counterbending phase indicated in FIG. 1D. These phases may be implemented by a compressive force acting in a plane 1.11 defined by edges 1.3, 1.4 and by diagonals 1.10 extending therebetween, or by a tensile force acting between edges 1.5, 1.6 for stretching the same apart. The box 1 is counterfolded into a prismatic form shown in FIG. 1D to remove stresses tending to return the erect box (FIG. 1C) to the collapsed form of FIG. 1A.

Figure 2:
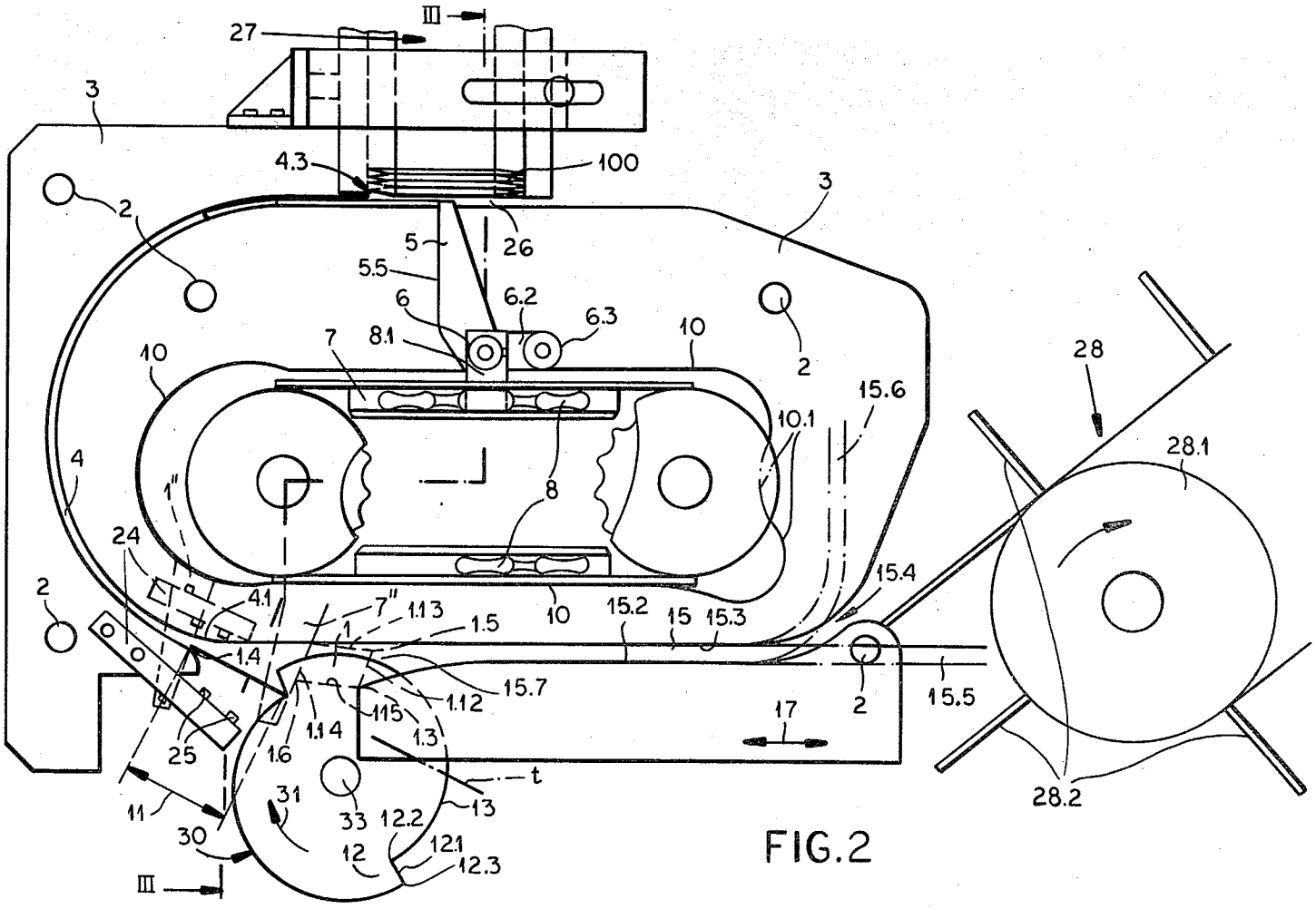
FIG. 2 is an elevational view of a device, according to our present invention, for automatically implementing the process illustrated in FIGS. 1A–1D.
Figure 3:
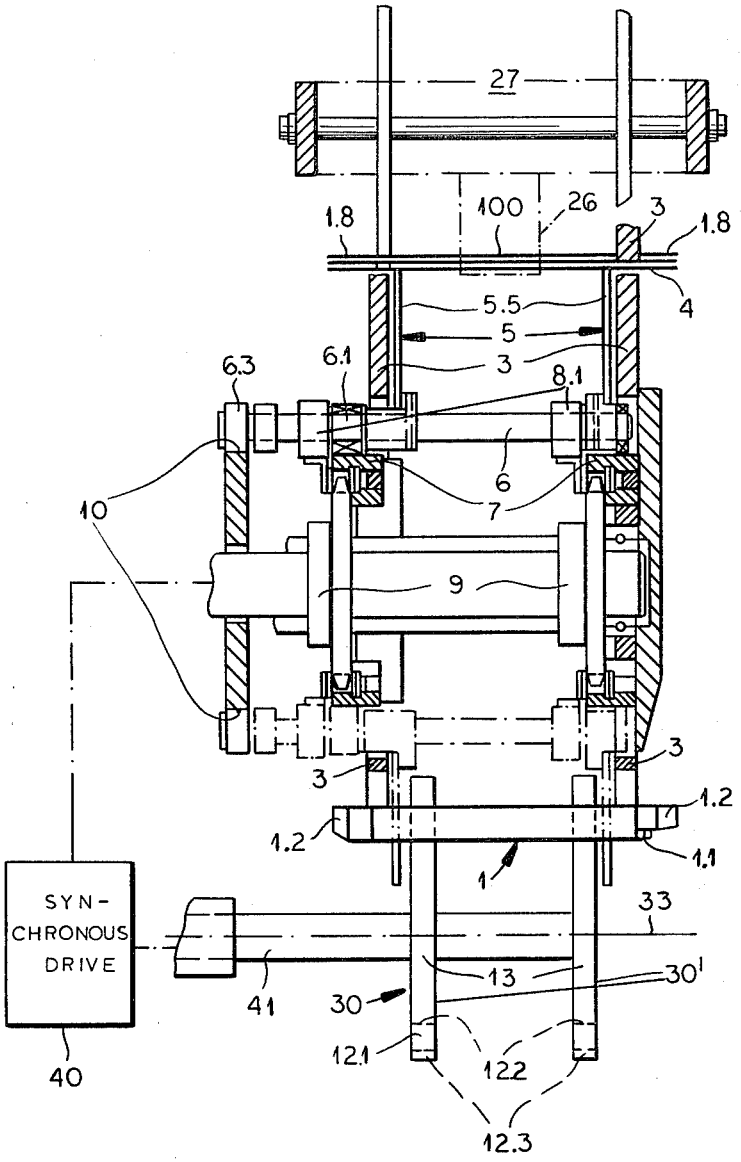
FIG. 3 is a cross-sectional view taken along line III—III in FIG. 2.

As shown in FIGS. 2 and 3, a device for automatically opening and counterbending box 1 from blank 100 comprises, according to our present invention, a frame 3 including a pair of parallel plates held together by spacer bolts 2 and having a pair of circular slots 4 serving to guide a blank 100 from a feed station 26 at the bottom of a stack assembly 27 to an erecting station at the outlet 4.1 of slots 4. A blank 1 is pushed through slots 4 by a carrier including a pair of arms 5 rigid with a shaft 6 which rides on two tracks 7 by means of wheels or rollers 6.1. Shaft 6 and arms 5 are driven along tracks 7 by endless chains 8 meshing with two pairs of toothed gears or sprockets 9, at least one of these pairs being turned by a rotary power source 40. Shaft 6 is connected by a spring-loaded linkage 8.1 to chain 8 and is rigid at one end with a lever 6.2 having a roller or wheel 6.3 which bears against a camming surface 10 under the twisting force exerted by linkage 8.1.

A blank 100 is engaged at back edge 1.4 by forward facing surfaces 5.5 of arms 5 and is pushed thereby along a path defined by slots 4. Upper leading edges 4.3 of these slots form a barrier for preventing entrainment by carrier 5–10 of any blank but the lowermost in stack 27. Through the action of arms 5, blank 100 maintains a transverse relationship with respect to slots 4, during a negotiating thereof from feed station 26 to erecting station 4.1, 12. More particularly, edges 1.3, 1.4 extend perpendicularly to slots 4, while projecting laterally therefrom are blank portions 1.8 at least including flaps 1.1 and 1.2. Blank 100 emerges from outlet 4.1 in the direction of a tangent t to strike a stopper 12 at front edge 1.3. As described more fully hereinafter with respect to FIGS. 4 and 5, upon being arrested in its translation by stopper 12, blank 100 is held between the same and carrier 5 and is subjected to a compressive force directed along diagonal 1.10 (see FIG. 1B) and arising from a relative motion of arms 5 and stopper 12. During a greater part of a spreading phase initiated with the arresting of blank 100 and terminated at the attaining of an erect form by box 1, box 1 opens under coaction of carrier 5–9 and stopper 12 and encounters no obstacles which might engage sides 1.12–1.15 and impede the lateral motion thereof.

A pair of stoppers 12 for arresting the forward motion of blanks 100 upon emergence thereof from outlet 4.1 and for coacting with arms 5 to exert a compressive force along the diagonals 1.10 of the blanks are formed on diametrically opposed sides of a carrier 30 mounted on frame 3 for rotation in a direction 3' about an axis 33 parallel to the orientation of the blanks' front and back edges 1.3, 1.4 upon the issuing thereof from guide slots 4. Stoppers 12 include respective radially extending surfaces 12.1 each connected at an inner side or edge 12.2, via a substantially spiral-shaped surface 13, with an outer side or edge 12.3 of the other stopper surface 12.1. As best seen in FIG. 3, carrier 30 comprises a pair of wheels 30' which have surfaces 12.1 and 13 as radial peripheries and which are mounted on a shaft 41 rotatable by drive 40 in synchronism with the motion of arms 5 for positioning a stopper at the erecting station substantially simultaneously with the emergence of a blank from the guide outlet 4.1. As illustrated in FIG. 2, inner edge 12.2 is thus revolved about axis 33 to be disposed at a distance 11 from outlet 4.1 equal to separation 1.9 for engaging forward edge 1.3. Each stopper has two radial surfaces 12.1, one on each wheel 30', having a separation defining an elongate dimension extending parallel to axis 33 and to blank edges 1.3, 1.4.

Frame 3 is provided with an exit guide formed by a pair of parallel slots 15 extending from an entrance opening 15.7 at stopper carrier 30 to an exit opening 15.4 at a conveyor belt 28 mounted on at least one rotary drum 28.1 and having compartment dividers 28.2 for catching and removing counterfolded boxes 1 from exit slots 15 and carrier arms 5. As shown in FIG. 2, camming surface 10 exhibits an undulation 10.1 proximate to opening 15.4 for facilitating the coaction of arms 5 and dividers 28.2 to eject counterfolded boxes from a device according to our present invention. Depending on subsequent operations, i.e. depending on the nature of equipment located downstream of the device shown in FIGS. 2 and 3, it may be necessary to omit conveyor 28 and to form the exit slots 15 to extend in a certain direction, such as horizontally or vertically as indicated by dot-dash lines 15.5, 15.6, respectively.

Blank carrier 5–10 may be provided with a multiplicity of arm and lever assemblies 5–6.3 spaced at points along track 7 to ensure a minimal interarm distance at slots 4 equal to separation 1.9. Drive 40 rotates carrier 30, between the arrival of successive arms 5 at outlet 4.1, through an angle equal to an integral multiple of 180°, while the rotation of drum 28 is coordinated with the revolution of chain 8 for properly synchronizing dividers 28.1 and arms 5.

Figure 4:
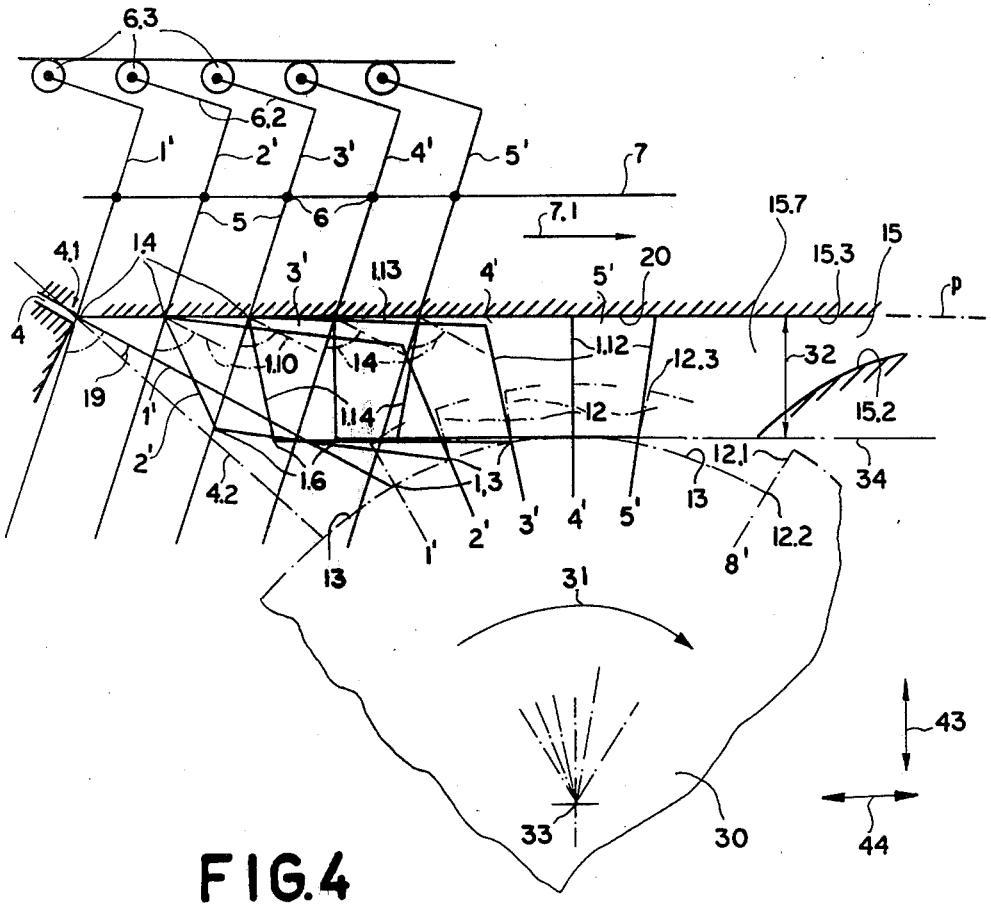
FIG. 4 is a schematic diagram showing successive states of the process of FIGS. 1A–1D as performed by the device of FIGS. 2 and 3.

The opening, erecting and counterfolding of a box 1 by a device according to our present invention are schematically illustrated in FIG. 4 by selective successive positions and orientations 1'–5' of a stopper 12 and arms 5 and correspondingly designated locations and forms of a box 1. A spreading phase begins with the engagement of front edge 1.3 and stopper 12, indicated at 1', and ends with the erection of the box at 4'. As shown in FIG. 4, a guide surface 20 on frame 3 extends from outlet 4.1 to connect with an upper surface or slot edge (or pair of slot edges) 15.3, guide surface 20 lying in a plane p which is parallel to a tangent plane 34 to wheels 30' at a small radius thereof. During the spreading phase and at least a portion of a subsequent collapsing phase, carrier arms 5 are controlled by camming surface 10 to have an angle of inclination less than 90° with respect to box diagonal 1.10, whereby arms 5 exert on the box 1 a force component pushing back edge 1.4 against surface 20 to slide therealong. It is to be noted that during the spreading phase (see references 2', 3'), the box engages only stopper 12 and arms 5 and encounters no opposition to lateral motion. Depending on the magnitude of a separation 32 between planes p and 34, the upper surface 1.13 of the box 1 may engage guide surface 20 during the collapsing phase, as indicated by box positions 4' and 5' in FIG. 4. Preferably, separation 32 is fractionally larger than the box dimension extending substantially transversely to plane p upon box erection; in this case, the box engages carrier arms 5 and surface 20 only at its back edge 1.4 during the spreading phase and the collapsing phase.

Upon termination of the collapsing phase, defined by the engagement of arm surfaces 5.5 and box side 1.14 (see designation 7'' in FIG. 5), the box has an angle of inclination 1.7 (see FIG. 1D) predetermined by the shape of camming surface 10 in a region about the erecting station. The continued motion of arms 5 in a direction indicated by an arrow 7.1 in FIG. 4 works to push the partially countercollapsed box 1 over and past stopper edge 12.3 into exit guide 15. As illustrated in FIG. 4, the entrance opening 15.7 of the exit slots 15 has a width substantially equal to plane separation 32. The slots have, for at least a portion of their length, a width inversely proportional to distance from opening 15.7, whereby a box 1 erected and counterfolded at station 4.1, 12, 13, 20, 30 is further collapsed en route to conveyor 28.

As indicated in FIG. 4 by a dot-dash line 4.2 extending from guide outlet 4.1 to carrier 30, a device according to our present invention will function properly if a blank emerging from the guide outlet strikes curved surface 13 rather than stopper 12. In this event, carrier arms 5 will induce the sliding along surface 13 of front blank edge 1.3 until the same is caughty by radial surface 12.1. Surface 13, in addition to performing this pre-erection function, also serves to arrest the lateral motion of a box during the pushing thereof past stopper 12 upon completion of the collapsing phase (designated in FIG. 5 at 7'').

Figure 5:
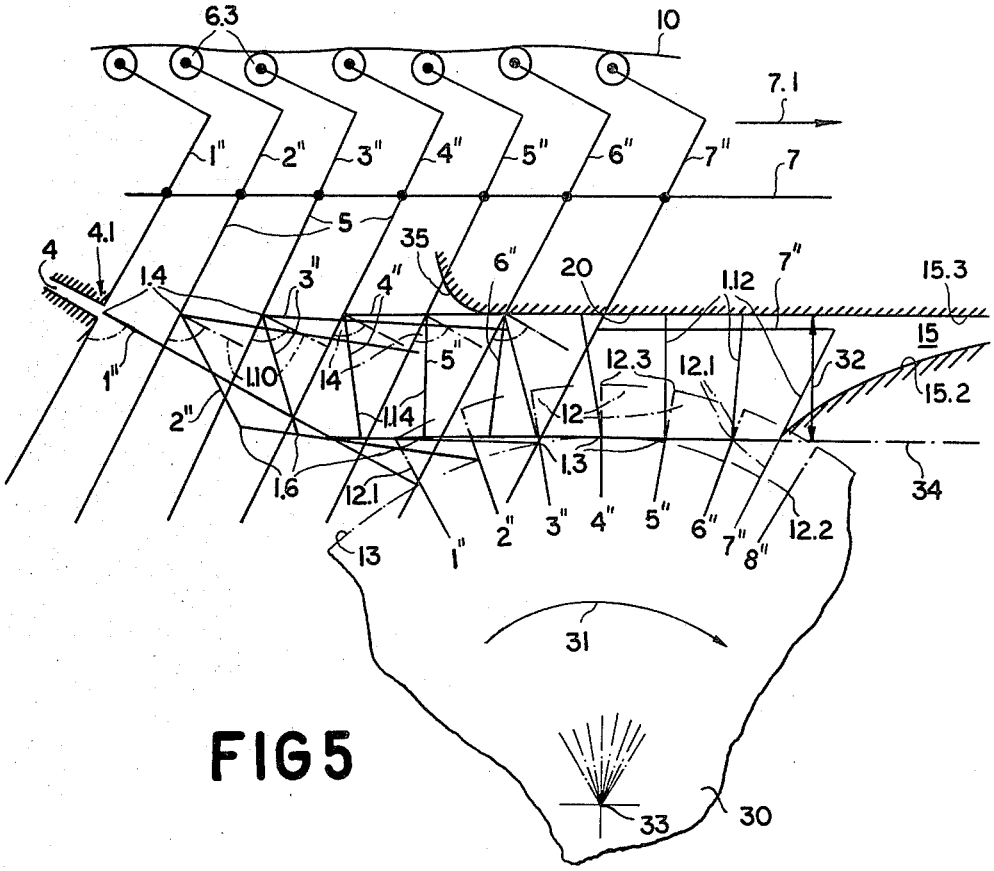
FIG. 5 is a diagram similar to FIG. 4.

An advantage of a box-erecting device according to our present invention is indicated in FIG. 4, and more particularly in FIG. 5, with respect to the inclination of stopper catching surface 12.1. Upon the emergence of a blank from guide outlet 4.1, a stopper 12 has been revolved so that its inner edge 12.2 is at a distance 11 from guide outlet 4.1 and so that catch surface 12.1 is inclined generally in the direction of this outlet. The inclination of surface 12.1 serves to ensure the catching of a blank's front edge 1.3. Because the stopper 12 continues to revolve about axis 33 during the subsequent spreading and collapsing phases, surface 12.1 is inclined away from guide outlet 4.1 and toward entrance opening 15.7 upon the termination at 7″ of the collapsing phase, whereby pushing of the counterbent box from the erecting station into the exit slots 15 is facilitated. While the box continues to enter the exit slots, the stopper is revolved entirely out of the way.

Generally, positions and orientations 1″–8″ of arm 5, box 1 and stopper 12 shown in FIG. 5 conform to correspondingly designated positions and orientations illustrated in FIG. 4. A substantial difference lies in the magnitude of an angle 14 subtended between arms 5 and box diagonal 1.10. As shown in FIG. 5, it is not necessary for guide surface 20 to be connected to guide outlet 4.1; guide surface 20 may instead be provided with an introductory guide portion 35. In order to prevent the motion of back box edge 1.4 with respect to arm surface 5.5 during the interval between the issuance of edge 1.4 from outlet 4.1 and the engagement of this edge with surface 20 or 35, camming surface 10 is shaped to give the carrier arm an angle of inclination of 90° with respect to box diagonal 1.10. Such an inclination angle eliminates any force component exerted on the blank by the carrier arm in a direction parallel to surface 5.5 and maximizes the friction force between the same and back box edge 1.4, thereby forming a locked engagement of the arm and this edge. A gripper such as a shoulder or a recess may be formed in arm surfaces 5.5 to further ensure a lock between arm 5 and back blank edge 1.4.

As indicated by arrows 43 and 44 in FIG. 4, rotary carrier 30 may be adjustably secured to frame 3 for varying the distance of axis 33 from guide surface 20 and from outlet 4.1 to facilitate the handling by the device of blanks of different front-back edge separations. As indicated by an arrow 17 in FIG. 2, lower edges 15.2 of exit slots 15 may be shiftable for varying the position and size of entrance opening 15.7 to correspond to resulting changes in plane separation 32 and the location of stopper carrier 30.

FIG. 2 shows a pair of pressurized-air guns 24 mounted on frame 3 laterally of outlet 4.1 and having nozzles 25 oppositely oriented for directing jets of air against flaps 1.1, 1.2 to exert a breaking-open force on a blank 100 prior to the striking of stopper 12 by the blank's front edge 1.3. Such a force acts in a manner analogous to the heretofore-described tensile force and serves to facilitate correct opening of a blank 100 under the action of carrier arms 5 and stopper 12.

We claim:

1. A device for automatically erecting and counterbending a box from a blank at least temporarily into a prismatic form, said box having four parallel edges formed as joints between respective pairs of box sides having widths measured perpendicularly to said edges and having at least two end flaps joined to said sides at opposite extremities of said box, a pair of opposite box sides having a small width and another pair of opposite box sides having a large width, said blank having a front edge and a back edge corresponding to two of said parallel edges and spaced by a separation equal to the sum of said small width and said large width, comprising:

a frame;

first guide means on said frame for directing said blank along a path extending from a feed station to a guide outlet juxtaposed to an erecting station;

a carrier arm movably mounted on said frame for engaging said back edge to push said blank along said path;

a stopper on said frame at said erecting station for engaging said front edge to arrest said blank upon emergence thereof from said first guide means and for coacting with said carrier during a spreading phase to exert on said box a compressive force oriented along a diagonal extending through said back edge and said front edge to said stopper, said stopper being shiftably mounted on said frame for revolving about an axis substantially parallel to said edges to be disposed, upon the mergence of said blank from said first guide means, substantially transversely to said path and parallel to said edges and at a distance from said outlet at least equal to said separation;

second guide means on said frame extending from said erecting station for receiving said box upon the termination of a collapsing phase;

feed means for delivering said blank to said feed station;

conveyor means for removing said box from said device;

drive means on said frame operatively connected to said arm for driving same along said path, past said erecting station and along said second guide means, whereby said blank is pushed through said first guide means, said arm is shifted relatively toward said stopper for creating said force, and said box is pushed from said erecting station through said second guide means to said conveyor means, said drive means being operatively connected to said stopper for revolving same about said axis in synchronism with the motion of said arm; and arresting means on said frame for limiting lateral motion of said box during pushing thereof by said arm from said erecting station to said second guide means, said stopper being mounted on a rotary carrier rotatable by said drive means about said axis, said arresting means including a curved surface contiguous on said rotary carrier with said stopper, said stopper being provided with a catch surface projecting substantially perpendicularly with respect to said curved surface and extending substantially toward said outlet upon an issuing of said front edge therefrom.

2. The device defined in claim 1 wherein said feed means includes a stack for storing a plurality of blanks for successive erecting by said device.

3. The device defined in claim 1 wherein said rotary carrier is adjustably mounted on said frame for selectively varying the distance of said axis from said outlet, whereby said device is enabled to accommodate blanks of different dimensions.

4. The device defined in claim 3 wherein said rotary carrier is in the shape of a wheel, said curved surface forming an outer periphery of said wheel.

5. The device defined in claim 4, further comprising a guide surface extending on said frame between said outlet and said second guide means for engaging said back edge to cooperate with said arm and said stopper in creating said compressive force to shorten said diagonal during said spreading phase and during a subsequent collapsing phase terminating in the engagement of said arm and a side of said box contiguous with said back edge, said guide surface being disposed in a plane located a distance from said curved surface at least equal to said small width, said drive means including pivoting means operatively connected to said arm for controlling an angle between said arm and said diagonal to be less than 90° during said spreading phase and said collapsing phase, whereby said back edge is forced against said guide surface to slide therealong.

6. The device defined in claim 5 wherein said guide surface is connected to said first guide means at said outlet.

7. The device defined in claim 4 wherein said drive means includes pivoting means for controlling the angle between said arm and said diagonal to be substantially equal to 90° at least during said spreading phase, whereby a friction force is maximized for preventing motion of said back edge relative to said arm.

8. The device defined in claim 4 wherein said arm is provided with gripper means for forming a locked engagement with said back edge during said spreading phase, whereby motion of said back edge relative to said arm is inhibited.

9. The device defined in claim 4 wherein said wheel has a plurality of stoppers in the form of peripheral teeth having respective radially extending surfaces each connected at an inner side to an outer side of an adjacent tooth via a curved surface and at an outer side to an inner side of another adjacent tooth via another curved surface, said curved surfaces being substantially spiral.

10. The device defined in claim 1, further comprising force-producing means on said frame juxtaposed to said outlet for exerting a pressure on said blank, upon the emergence thereof from said guide means and prior to the engagement of said front edge and said stopper, to ensure proper spreading of said box upon application of said compressive force.

11. The device defined in claim 10 wherein said flaps are attached to opposite sides of said box and wherein said force-producing means includes a pair of pressurized-air nozzles disposed on said frame on opposite sides of said first guide means for ejecting respective air streams in opposed directions against said end flaps for exerting a breaking-open force on said blank prior to the engagement of said front edge and said stopper.

12. The device defined in claim 1 wherein said second guide means has an opening width inversely proportional to distance from said erecting station, whereby said box is further counterbent upon pushing thereof through said second guide means.

* * * * *